United States Patent [19]

Ausnit

[11] Patent Number: 4,514,962

[45] Date of Patent: May 7, 1985

[54] METHOD AND APPARATUS FOR FILLING RECLOSABLE BAGS

[75] Inventor: Steven Ausnit, New York, N.Y.

[73] Assignee: Minigrip, Inc., Orangeburg, N.Y.

[21] Appl. No.: 450,243

[22] Filed: Dec. 16, 1982

[51] Int. Cl.[3] ..... B65B 43/12; B65B 9/08

[52] U.S. Cl. ..... 53/457; 53/384; 53/469; 53/568; 53/570

[58] Field of Search ..... 53/384, 457, 469, 492, 53/570, 568, 450

[56] References Cited

U.S. PATENT DOCUMENTS

| | | | |
|---|---|---|---|
| 3,699,746 | 10/1972 | Titchenal et al. | 53/384 |
| 3,744,211 | 7/1973 | Titchenal et al. | 53/29 |
| 3,751,875 | 8/1973 | Membrino | 53/568 |
| 4,162,602 | 1/1979 | Achelpohl et al. | 53/469 |
| 4,169,345 | 10/1979 | Douwenga | 53/384 |
| 4,333,299 | 6/1982 | Hamilton | 53/450 |
| 4,387,550 | 1/1983 | Lerner | 53/469 |
| 4,423,583 | 1/1984 | Carey | 53/384 |

*Primary Examiner*—W. D. Bray

*Attorney, Agent, or Firm*—Hill, Van Santen, Steadman & Simpson

[57] ABSTRACT

Bags supplied in a chain are advanced step by step through a filling station wherein lip flanges on the bag tops are clampingly gripped and pulled apart to separate a reclosable profile fastener, the bag filled and then released from the clamps, and advanced from the filling station. In one arrangement clamp assemblies separate for pulling the flanges apart to open the bag to be filled and a filling nozzle may be inserted down between the separated clamp assemblies. In another embodiment the clamp assemblies include a collapsible and expandable multi-panel funnel assembly through which bag filling contents are delivered into the open bag. Each filled bag is advanced from the filling station and the fastener reclosed after leaving the filling station. The lip flanges may be treated along a transverse separation line to facilitate separation of the filled bag from the next succeeding bag.

18 Claims, 8 Drawing Figures

METHOD AND APPARATUS FOR FILLING RECLOSABLE BAGS

This invention relates to improvements in a method of and apparatus for filling reclosable bags of the type formed from sheet material carrying releasable and reclosable complementary profile fastener means, and adapted to be supplied to bag filling equipment in a continuous chain of the bags.

As supplied in continuous chain fashion, reclosable bags having separable fastener means of the resilient tongue and groove type have the fasteners closed. Generally, though not necessarily, such bags are made from extruded thermoplastic material and the fastener profiles are integral with the bag walls, and with lip flanges projecting upwardly from the fastener profiles to serve as convenient pull flanges when it is desired to open the fastener means for access into the interior of the bags.

Heretofore, bags of this type have frequently been filled from open bottom ends thereof, and such bottom ends then heat sealed after the filling operation. This entails the additional step of heat sealing which, if it can be eliminated, will speed the filling process and provide a desirable processing economy.

The present invention has as its principal object the provision of a new and improved method of and means for filling reclosable bags through their mouth or top ends, thereby permitting the bags to be made from folded sheet material wherein the bottom ends of the bags are closed when supplied to the bag filling equipment.

To this end, the present invention provides a method of seriatim filling of closed bottom bags at a filling station, and wherein the bags are the kind supplied in a chain and have closed sides and aligned tops closed by reclosable profiled fastener means from which a pair of confronting lip flanges projects upwardly and extends continuously along the top of the chain, comprising receiving each of the lip flanges between separable clamping means; permitting relative movement of the lip flanges and the clamping means in an open phase of the clamping means; firmly clamping the lip flanges in said clamping means in a clamping phase of the clamping means; cyclically operating the clamping means through each of said phases, and in said clamping phase actuating the clamping means for pulling the lip flanges apart and thereby separating the reclosable fastener means of each bag at the bag filling station; and after filling of each bag at the station advancing the filled bag from the station and reclosing the fastener means of the filled bag.

The present invention also provides an apparatus including a filling station for seriatim filling of closed bottom bags of the kind supplied in a chain and wherein the bags have closed sides and aligned tops closed by reclosable profiled fastener means from which a pair of confronting lip flanges projects upwardly and extends continuously along the top of the chain, and comprising separable clamping means for receiving each of the lip flanges therebetween and having an open phase permitting relative movement of the lip flanges and the clamping means, and a clamping phase wherein the lip flanges are firmly clamped by the clamping means; means for cyclically operating the clamping means through each of said phases, and adapted in said clamping phase for actuating the clamping means for pulling the lip flanges apart and thereby separating the reclosable fastener means of each bag at the filling station; and means for advancing each filled bag from the filling station and for reclosing the fastener means of the filled bag.

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which.

Figure 1:
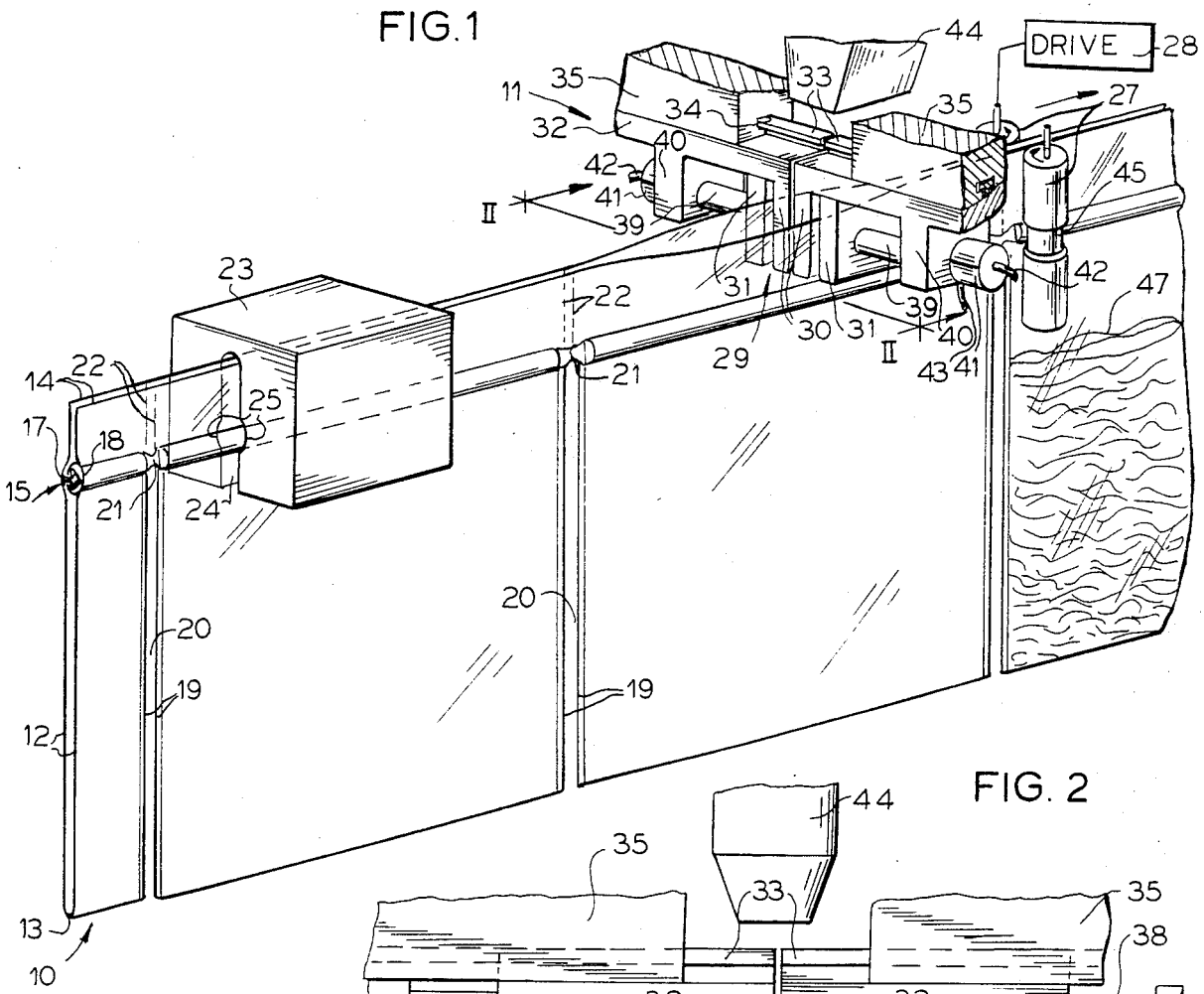
FIG. 1 is a more or less schematic perspective view showing bags supplied in chain fashion in bag filling apparatus.

Referring to FIGS. 1–4, a chain of reclosable bags 10 is supplied for filling at a filling station having filling apparatus 11. The bags 10 are desirably formed from extruded thermoplastic film material folded to provide bag side walls 12 joined by a bag bottom closure fold 13. At their mouth or upper ends the side walls 12 terminate in respective lip flanges 14 which project upwardly from separable fastener means 15 comprising a resilient rib profile 17 on one of the side walls 12 releasably engagable in a complementary resilient groove formation 18 in the opposite side wall 12. The profiles 17 and 18 are adapted to be pressed together into interlocking relation and are adapted to be separated by pulling them apart through manipulation of the lip flanges 14. Although the profiles 17 and 18 may be of various complementary formations, as is well known in the art, an arrow head shaped rib profile and complementary groove formation are depicted. Each of the bags 10 is sealed as by means of a heat seal 19 along each side, and extending from the bottom 13 along a separation 20 to the fastener 15. The profiles 17 and 18 are fused together at the sides of the bags, in alignment with the side seals 19, and the fused ends of the sections of the fastener 15 on the bags are connected by integral fused spot seal connecting links 21 aligned with the separation 20. These links 21 are of thin enough section to permit snap apart separation when desired, but strong enough to retain the bags 10 in a continuous chain relationship for prefilling handling and transportation by pulling through the filling station. However, each of the lip flanges 14 remains in a continuous separated condition for handling and transportation through the filling station. Means comprising transverse perforations 22 generally aligned with the sealed side edges 19 may be formed in the flanges 14 to permit snap apart separation after the bags have been filled. While FIG. 1 discloses a preferred embodiment of the bag chain, another construction can be provided wherein an interlocking fastener with integral lower attachment flanges profiles and upper lips is continuously sealed by the attachment flanges to the edges of a film parallel with and adjacent to said edges.

Any suitable means may be provided for supporting the chain of bags 10 for feeding to the filling station apparatus 11. By way of example, a tracking device 23 is depicted, located upstream from the apparatus 11 and having complementary a guide slot 24 through which the upper portion of the chain of bags travels. The sides of the slot 24 are formed with respective cooperative tracking grooves 25 through which the bead provided by the fastener 15 is slidably engaged for supporting the bags in upright filling position. Means for supporting and advancing the chain of bags 10 by bag increments through the filling station comprises a pair of pinch rolls 27 located at a suitable position adjacently downstream from the bag filling apparatus. At least one of the rollers 27 may be driven by means 28 in a dwell and advance manner to advance the bags 10 through the filling cycle. The bag chain can also be supported by means of a driven belt running underneath it.

In the filling station, the lip flanges 14 are adapted to be engaged by clamping means 29 which have an open phase permitting relative movement of the lip flanges and the clamping means, and a clamping phase wherein the lip flanges are firmly clamped by the clamping means for effecting opening of the fastener 15 of the bag 10 when it is registered with the filling apparatus. In one desirable form, the clamping means 29 comprises a pair of respective finger-like clamping jaws 30 arranged to project down between and in opposing relation to the interfaces of the respective flanges 14 which are to be clamped against the jaw 30 by a respective separably mounting cooperating jaw 31 engagable with the outer side of the flange. In a preferred construction, each of the jaws 30 is rigid with and depends from an overhead elongate carriage 32 and each of which carriages projects in the opposite direction from the other one. Each of the carriages 32 has on its upper side a parallel dovetail runner 33 engaged in a complementary dovetail track 34 in an associated supporting structure 35. This enables the carriages 32 to be guidedly reciprocated toward and away from one another to move the jaws 30 transversely relative to the flanges 14. Means for effecting reciprocation of each of the carriages 32 comprises a pneumatic cylinder actuator 37 having a piston rod 38 connected to the associated carriage.

Each of the clamping jaws 31 is reciprocably related to its companion clamping jaw 30 and for this purpose is carried by a plunger 39 which may be a piston rod 39 projecting through a depending bracket 40 on the associated carriage 32. At its end opposite the jaw, the piston rod 39, in each instance, has a pneumatic piston **39*a* in a cylinder actuator 41 to which are connected combination compressed air delivery and exhaust ducts 42 and 43** for selectively reciprocating the plunger in either direction.

Figure 2:
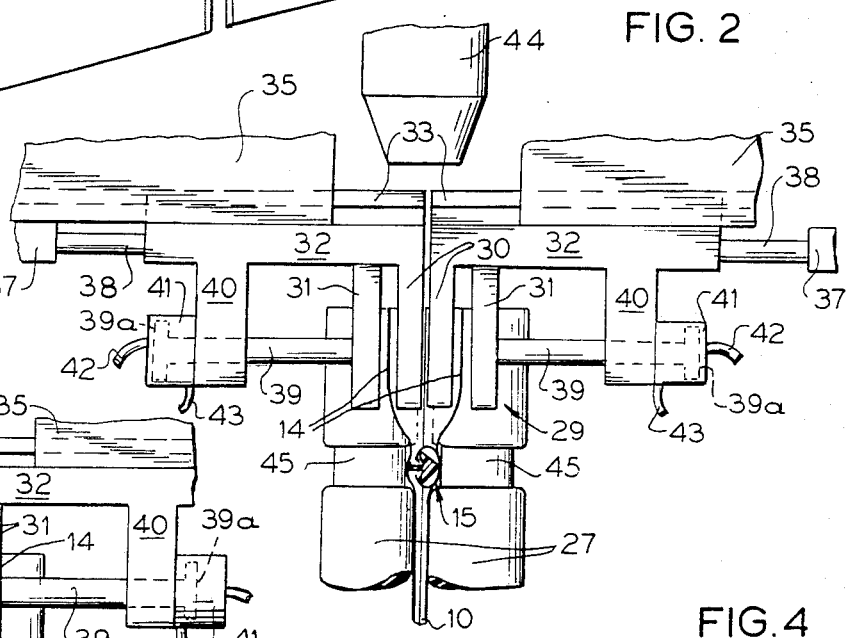
FIG. 2 is a fragmentary sectional elevational view taken substantially in the plane of line II—II of FIG. 1 and showing bag-opening clamps in an open phase.
Figure 3:
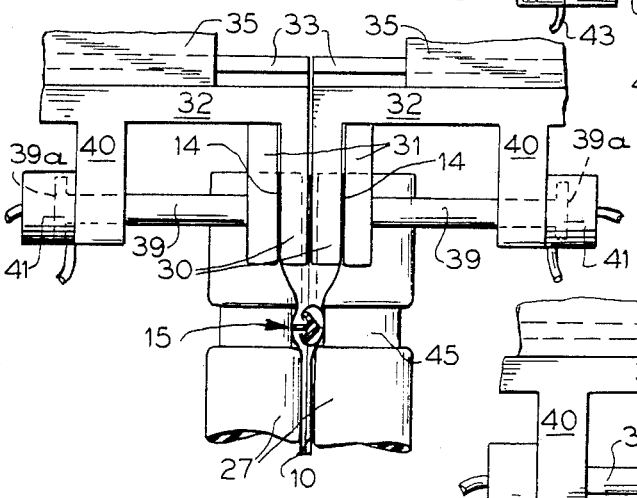
FIG. 3 is a view similar to FIG. 2, but showing the clamps in a clamping phase.

In the operation of the filling apparatus 10, the clamps 29 remain in their open phase, as shown in FIGS. 1 and 2, and with the jaws 30 close to one another, while the chain of bags 10 is advanced to bring a bag to be filled into registration under a filling nozzle 44 which at this time is raised to a clearance position above the clamping mechanism. In this open phase, and the respective jaws 31 are in open, spaced relation to the companion jaws 30 so that the lip flanges 14 which extend upwardly between the jaws can move freely longitudinally therethrough as the bag chain is advanced.

Figure 4:
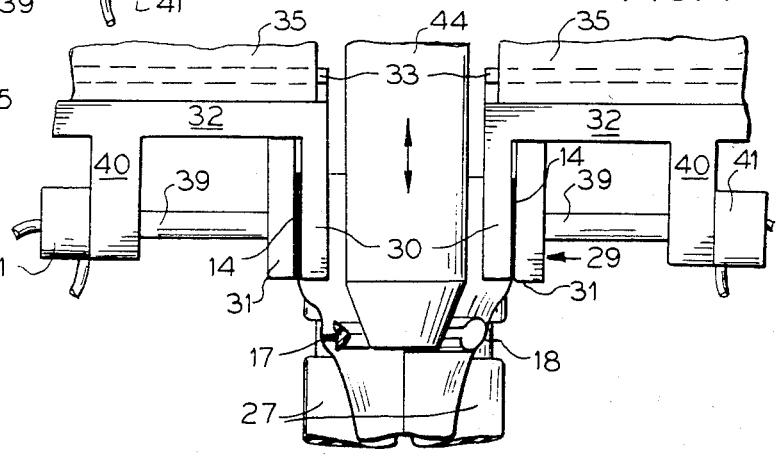
FIG. 4 is a view similar to FIG. 3, but showing the bag opened for filling.

When the bag 10 to be filled is in centered relation below the nozzle 44, the bag chain is caused to dwell, and the actuators 41 are activated to drive the jaws 31 toward the jaws 30 and into clamping engagement with the lip flanges 14 which are thereby firmly gripped in the respective clamps. In coordinated relation with such clamping of the lip flanges 14, the actuators 37 are activated to draw the clamp assemblies apart, as shown in FIG. 4, thereby separating the fastener profiles 17 and 18 of the registered bag 10 and spreading the mouth of the bag apart sufficiently to receive the filling nozzle 44 therein, preferably with its discharge end in at or slightly below the profiles 17 and 18 so that the profiles will escape contamination from material discharged from the filling nozzle into the bag. However, in certain instances where contamination is of no consequence the nozzle could remain stationary. As soon as the fill for the bag contents has been discharged from the nozzle 44, the nozzle 44 is withdrawn, and the actuators cause the clamps to return to the proximate relative position of FIG. 3. Then by activation of the actuators 41, the clamping jaws 31 are backed off from the jaws 30 to release the lip flanges 14, so that the filled bag can be advanced from the filling station and a succeeding bag 10 registered with the filling nozzle 44.

As the bag chain 10 is advanced, the pinch rolls 27 reclose the fastener 15. For this purpose, it will be observed, each of the pinch rolls has a shallow groove 45 which serves not only to guide the fastener rib and thereby assists in supporting the bag chain downstream from the filling station, but also provides a root surface oriented in complementary relation to the groove root surface 45 of the companion pinch roll so as to apply fastener reclosing pressure, without crushing the fastener assembly. After each filled bag with its contents 47, and its section of the separable fastener 15 closed, has advanced a desired distance beyond the filling station, the filled bag is detached by breaking its connection with the chain, i.e., by breaking the spot seal link 21 and separating the lip flanges at the perforations 22.

On reference to FIGS. 5–8, showing another form of the invention, a chain of bags 48 to be filled by filling station apparatus 49, comprises a preferably one piece sheet plastic material providing bag side walls 50 joined at a folded joint bottom closure 51 and having at their upper ends lip flanges 52 projecting upwardly from a separable resilient fastener 53 comprising a male profile 54 on one of the side walls and a female profile 55 on the other of the side walls 50. In this instance the contiguous bags 48 have heat sealed side edges 55 joined along a tear line or web 57 which may be perforated for ease in effecting separation when desired. At the top of the tearline 57 in each instance, the fastener 53 is fused at a spot seal 58, providing a link which is strong enough to permit seriatim advance and filling of the bags but which will permit eventual separation of the filled bags from the chain.

Advance of the chain of bags 48, for registering each successive bag to be filled in the filling station in alignment with the filling apparatus 49, is adapted to be effected between pinch rolls 59 of which there are preferably two sets in which the rolls of each set are spaced narrowly from the rolls of the other set. At least one of the pinch rolls 59 may be driven by suitable driving means 60 in an advance and dwell manner for thereby advancing the chain of bags 48 one bag section at a time into registration with the filling apparatus 49 and thereby causing the bag to be filled to dwell until filling thereof has been completed, whereupon the chain of bags is advanced another bag width. It will be observed that the pinch rolls 59 have annular grooves 61 to facilitate engagement of the fastener 53 for not only supporting and guiding the bag chain downstream from the filling apparatus 49 but also for closing the separable fastener 53 after a filling operation.

Figure 5:
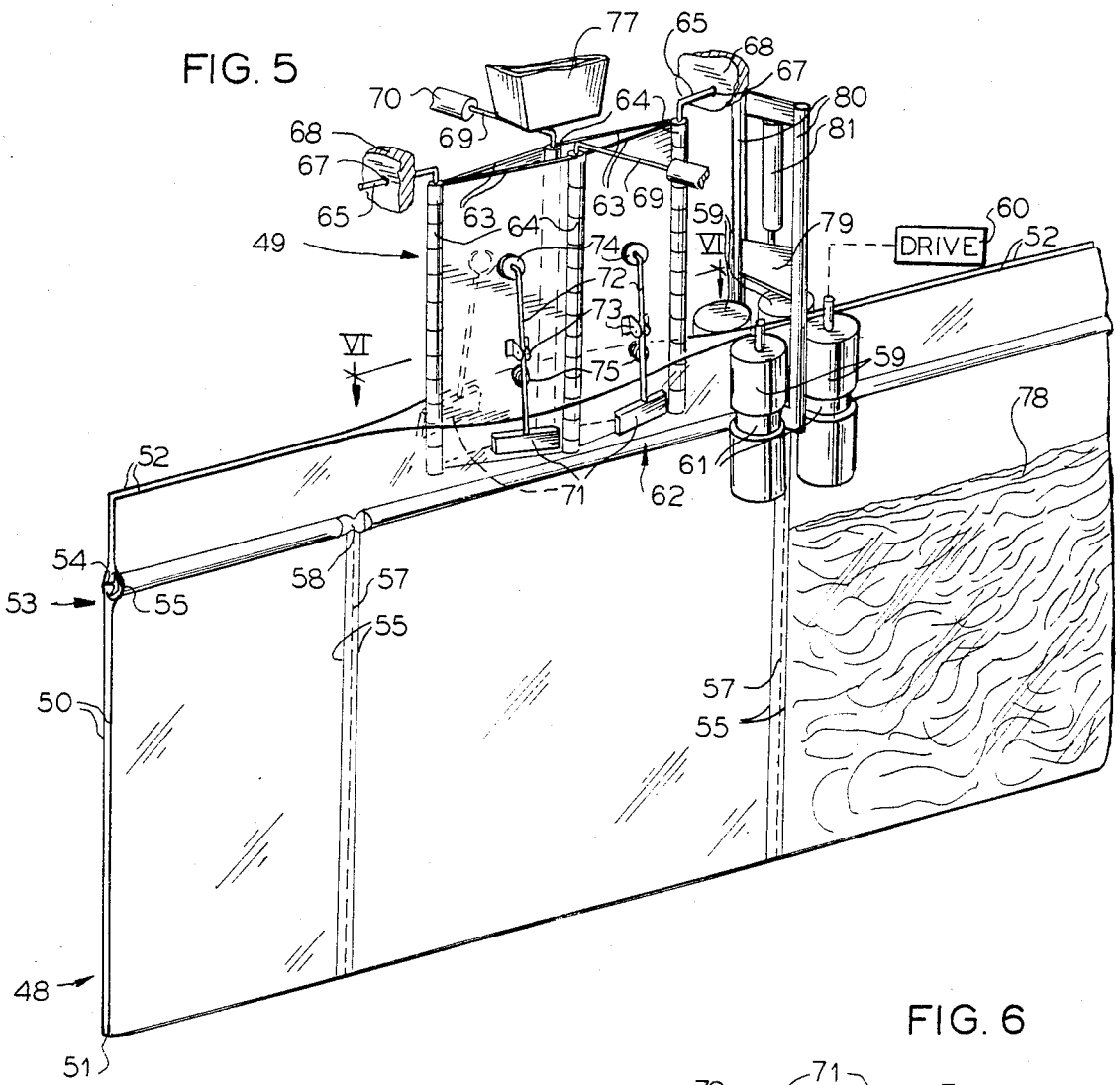
FIG. 5 is a schematic perspective view showing a modification.
Figure 6:
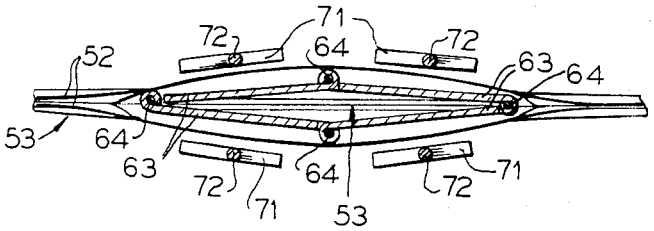
FIG. 6 is a sectional plan view taken substantially along the line VI—VI of FIG. 5 showing the lip flange clamping means in an open phase.
Figure 7:
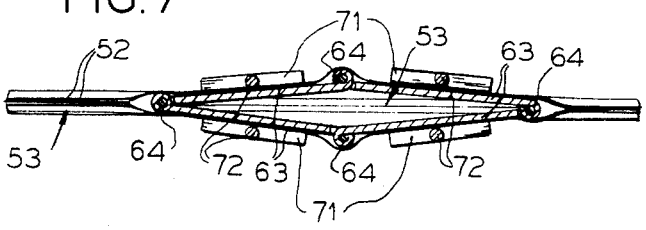
FIG. 7 is a view similar to FIG. 6 but showing the clamping means in a clamping phase.
Figure 8:
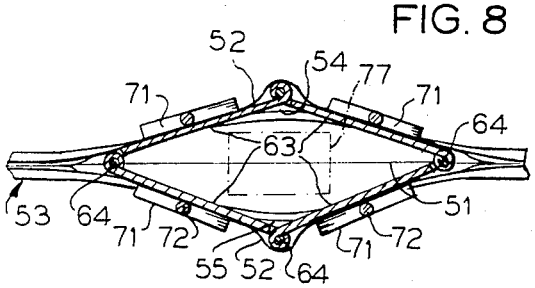
FIG. 8 is a view similar to FIG. 6 and 7 but showing the bag opened for filling.

In this instance, the filling apparatus 49 includes clamping means 62, which combines the functions of clamping the lip flanges 52 for opening the bag top including the separable fastener 53 and of a funnel structure to facilitate loading of contents into the bag to be filled. To this end, a four panel vertical funnel is provided wherein panels 63 are hingedly connected as at 64 into a collapsible quadrilateral structure which, when collapsed as shown in FIGS. 5, 6 and 7 provides a fairly flat unit which will fit easily between the lip flanges 52 without straining the fastener 53, thereby permitting the lip flanges 52 to ride past the lower end portion of the collapsed funnel during advances of the chain of bags 48. Support for the collapsible funnel is adapted to be provided by means such as axially aligned and oppositely extending hinge pin terminal head end extensions 65 which are mounted on axes parallel to and in the plane of the bag chain 48. The extensions 65 are received slidably in guide bores 67 of supporting structures 68. For collapsing and opening the funnel structure, the remaining two hinge pins may have respective lateral head extensions 69 which are connected to respective actuators 70 by which the extensions 69 are adapted to be reciprocated toward and away from one another and thereby selectively effecting collapsing and opening of the funnel.

Each of the funnel panels 63 serves as one jaw of the clamping means 62 and with which a relatively moveable jaw 71 cooperates to clamp the lip flanges 52 when desired. Each of the clamping jaws 71 is desirably carried by a generally downwardly extending rocking arm lever 72 mounted intermediately on a pivot 73 carried by the associated panel 63 and with the upper end of the lever connected to an actuator 74 carried by the associated panel 63 and adapted for selectively rocking the lever 73 for driving the associated clamping jaw 71 from an open position into clamping engagement with the clamping jaw surface provided by the associated panel 63. Means for returning the jaws 71 to the open-clamp relation desirably comprises a respective biasing spring 75 acting on each lever arm 72 below the pivot 73. It will be understood, of course, that operation of the drive 60, the actuators 70 and the actuators 74 will be effected in coordinated relation and in an operating cycle, by means of any preferred operating circuitry which may involve pneumatics, electro-pneumatics, or the like.

In a cycle of operation of the bag filling apparatus 49, after one of the bags 48 has been filled, the funnel assembly will be in the collapsed condition shown in FIGS. 5 and 6 and wherein the clamping means 62 is in the open phase, that is, the moveable clamp members 71 are spaced from the cooperative clamp portions of the funnel panels 63, so that the lip flanges 52 can move freely through the open clamp assemblies. This permits a bag 48 to be filled to be brought into filling registration relative to the apparatus 49.

Upon the bag 48 to be filled reaching the filling registration position, the bag chain is caused to dwell until filling of the bag has been completed. The clamping means 62 is caused to enter the clamping phase, visualized in FIG. 7, wherein the clamping members 71 firmly clamp the lip flanges 52 against the funnel panels 63. Then, while the clamping means 62 remains in the clamping phase, the actuators 70 cause the funnel panels 63 to move into expanded funnel relation as visualized in FIG. 8. Since the lip flanges 52 of the bag 48 to be filled are firmly gripped by the clamps, the mouth of the bag is pulled open, separating the fastener profiles 54 and 55 into a gaping mouth relation for receiving from a filling nozzle 77 a charge of contents 78. Promptly after bag filling has been completed, the funnel assembly is collapsed by operation of the actuators 70, the clamping means 62 enters the open phase, and the pinch rolls 59 advance the filled bag 48 from the filling station and effect reclosing of the fastener profiles 54 and 55 by opposed pressure from the root surfaces in the grooves 61.

After the bag 48 filled with the contents 78 (FIG. 5) has been fully advanced from the bag filling station and the succeeding bag 48 has been registered for filling, the pinch rolls 59 halt, with one set of the rolls 59 on one side of the tear line 57 between the filled bag and the next succeeding bag, and the other set of pinch rolls 59 on the other side of the tear line. Then, the lip flanges are treated by means which may be operated for separating the section of the lip flanges 52 on the filled bag 48 from the section of the lip flanges 52 on the next succeeding bag in the chain 10. In one possible arrangement, such means comprise a guillotine shearing blade 79 reciprocably mounted in a vertical trackway 80 and operated as by means of a cylinder actuator 81. Normally, the blade 79 is held at an elevation above the lip flanges 52. Actuation of the blade 79 in a downward cutting stroke limited to just above the spot seal 58 causes the lip flanges 52 to be severed. This severing action is facilitated by virtue of the lip flanges being held taut by and between the spaced sets of pinch rolls 59. On completing the shearing stroke, the blade 79 is instantly returned to the raised inactive position.

If preferred, the lip flange shearing device may be replaced by conventional heat sealing means for effecting a heat seal tear line separation across the lip flanges 52 aligned with the adjacent spot seal 58 so that subsequently the filled bag including its lip flanges 52 may be torn loose from the bag chain. An advantage of the heat seal tear line across the flanges 52 is that this seals the ends of the lip flange section of the filled bag 48 so that the lip flanges will then serve not only as pull flanges when it is desired to open the bag but also conveniently as a pouring funnel.

It will be understood that variations and modifications may be effected without departing from the spirit and scope of the novel concepts of this invention.

I claim as my invention:

1. A method of seriatim filling of closed bottom bags at a filling station, and wherein the bags are of the kind supplied in a chain and have closed sides and aligned tops closed by reclosable profiled fastener means from which a pair of confronting lip flanges project upwardly and extend continuously along the top of the chain, comprising:

receiving each of said lip flanges between separable clamping means;

permitting relative movement of the lip flanges and the clamping means in an open phase of the clamping means;

firmly clamping said lip flanges in said clamping means in a clamping phase of the clamping means;

cyclically operating said clamping means through each of said phases, and in said clamping phase actuating the clamping means for pulling said lip flanges apart and thereby separating said reclosable fastener means of each bag at said bag filling station; and after filling of each bag at said station advancing the filled bag from said station and reclosing the fastener means of the filled bag.

2. A method according to claim 1, wherein said clamping means comprise a respective clamping assembly for each of said lip flanges, and said method further includes effecting separation of said clamping assemblies relative to one another for pulling said lip flanges apart, and causing a filling nozzle to enter between the separated clamping assemblies for filling a charge contents into the bag at said filling station.

3. A method according to claim 1, wherein said clamping means include a collapsible and expandable funnel structure, and delivering a bag filling contents charge through the expanded funnel structure.

4. A method according to claim 1, comprising advancing the filled bag and reclosing the separable fastener means by operating pinch rolls engaging the top of the filled bag.

5. A method according to claim 1, comprising, after the filled bag has been advanced from the bag filling station, treating of the lip flanges for separation of that section of the lip flanges which is on the filled bag from the lip flange section on the next succeeding bag in the chain.

6. A method according to claim 5, wherein said treating comprises severing said lip flange sections from one another along a severance line across the lip flanges.

7. A method according to claim 6, comprising facilitating said severing by maintaining said lip flanges taut while effecting said severing.

8. Apparatus including a filling station for seriatim filling of closed bottom bags of the kind supplied in a chain and wherein the bags have closed sides and aligned tops closed by reclosable profiled fastener means from which a pair of confronting lip flanges project upwardly and extend continuously along the top of the chain, and comprising:

separable clamping means for receiving each of said lip flanges therebetween and having an open phase permitting relative movement of the lip flanges and the clamping means, and a clamping phase wherein said lip flanges are firmly clamped by said clamping means;

means for cyclically operating said clamping means through each of said phases, and adapted in said clamping phase for actuating the clamping means for pulling said lip flanges apart and thereby separating said reclosable fastener means of each bag at said filling station; and means for advancing each filled bag from said filling station and for reclosing said fastener means of the filled bag.

9. Apparatus according to claim 8, wherein said clamping means comprise a respective clamping assembly for each of said lip flanges, means for effecting separation of said clamping assemblies relative to one another for pulling said lip flanges apart, and a filling nozzle adapted to enter between the separated clamping assemblies for filling a charge contents into the bag at said filling station.

10. Apparatus according to claim 8, wherein said clamping means include a collapsible and expandable funnel structure, and means for delivering a bag filling contents charge through the expanded funnel structure.

11. Apparatus according to claim 8, comprising pinch rolls for engaging the top of the filled bag and operable for advancing the filled bag and reclosing the separable fastener means on the filled bag.

12. Apparatus according to claim 8, including means operable after the filled bag has been advanced from the bag filling station for treating the lip flanges for separation of the section of the lip flanges on the filled bag from the lip flange section on the next succeeding bag in the chain.

13. Apparatus according to claim 12, wherein said treating means comprises a device for severing the lip flange sections from one another along a severance line across the lip flanges.

14. Apparatus according to claim 13, including means for maintaining the lip flanges taut and thereby facilitating the severing.

15. Apparatus according to claim 14, wherein said means for severing comprises a guillotine blade, and means for operating said blade.

16. Apparatus according to claim 15, wherein said means for maintaining the lip flanges taut comprise spaced sets of pinch rolls engaging said lip flanges, and said guillotine blade operating to severe the lip flanges between said sets of pinch rolls.

17. Apparatus according to claim 8, wherein said separable clamping means comprise respective finger-like clamping jaws carried by reciprocable carriages and extending into engagement with inner faces of said lip flanges, respective moveable clamping jaws carried by said carriages for engagement with the outer faces of said lip flanges, means for actuating said moveable clamping jaws into and out of clamping engagement with said finger-like jaws, and means for effecting reciprocable movement of said carriages toward and away from one another.

18. Apparatus according to claim 8, wherein said clamping means comprise an expandable funnel structure having four hingedly connected panels, means for collapsing and expanding said funnel structure by actuation of said panels, end portions of the panels being receivable between said lip flanges, clamping jaw means carried by said flanges and adapted for engaging outer faces of said lip flanges, and means for actuating said moveable jaw means between open relation to said panels and lip clamping relation to said panels.

* * * * *